US010518397B2

(12) United States Patent
Ishikawa et al.

(10) Patent No.: US 10,518,397 B2
(45) Date of Patent: Dec. 31, 2019

(54) DRIVING TOOL

(71) Applicant: MAKITA CORPORATION, Anjo-shi, Aichi (JP)

(72) Inventors: Naoharu Ishikawa, Anjo (JP); Isao Miyashita, Anjo (JP); Noriyuki Nishido, Anjo (JP); Hiroyuki Fukui, Anjo (JP)

(73) Assignee: MAKITA CORPORATION, Anjo (JP)

( * ) Notice: Subject to any disclaimer, the term of this patent is extended or adjusted under 35 U.S.C. 154(b) by 251 days.

(21) Appl. No.: 15/553,149

(22) PCT Filed: Mar. 22, 2016

(86) PCT No.: PCT/JP2016/059004
§ 371 (c)(1),
(2) Date: Aug. 23, 2017

(87) PCT Pub. No.: WO2016/152862
PCT Pub. Date: Sep. 29, 2016

(65) Prior Publication Data

US 2018/0117748 A1 May 3, 2018

(30) Foreign Application Priority Data

Mar. 24, 2015 (JP) ..... 2015-060770

(51) Int. Cl.
*B25C 1/04* (2006.01)
*B25C 1/06* (2006.01)
*B25C 5/15* (2006.01)

(52) U.S. Cl.
CPC ..... *B25C 1/043* (2013.01); *B25C 1/046* (2013.01); *B25C 1/06* (2013.01); *B25C 1/047* (2013.01); *B25C 5/15* (2013.01)

(58) Field of Classification Search
CPC ..... B25C 1/043; B25C 1/046; B25C 1/06; B25C 1/047; B25C 5/15
(Continued)

(56) References Cited

U.S. PATENT DOCUMENTS 4,298,072 A 11/1981 Baker et al.
5,597,106 A * 1/1997 Hamano ..... B25C 1/008 227/130
(Continued)

FOREIGN PATENT DOCUMENTS

JP S56-039881 A 4/1981
JP H08-276375 A 10/1996
(Continued)

OTHER PUBLICATIONS

Jun. 7, 2016 International Search Report issued in International Patent Application No. PCT/JP2016/059004.
(Continued)

*Primary Examiner* — Alexander M Valvis
*Assistant Examiner* — Himchan "Aiden" Song
(74) *Attorney, Agent, or Firm* — Oliff PLC

(57) ABSTRACT

A driving tool including a first mode wherein a mechanical starting control is performed, and a second mode wherein an electrical starting control is performed, where these modes are configured to be switchable. Only in the second mode, if the elapsed time between the on-operation of a trigger and an on-operation of a contact arm does not exceed a reference time $T_0$, then a second actuation portion can be turned to an on-position to perform a driving operation. In the first mode, in contrast to the electric control, without consuming battery power, the driving operation can be performed by the mechanical control that is made by an operational order of the trigger and subsequently the contact arm. Because of this
(Continued)

configuration, even if power supply is shut off, the driving operation by the first mode can be continued.

13 Claims, 7 Drawing Sheets

(58) Field of Classification Search
USPC ..... 227/8, 120, 119, 123, 131, 129, 130
See application file for complete search history.

(56) References Cited

U.S. PATENT DOCUMENTS

| | | | | |
|---|---|---|---|---|
| 5,732,870 | A | 3/1998 | Moorman et al. | |
| 5,772,096 | A * | 6/1998 | Osuka | B25C 1/008 227/130 |
| 2009/0159633 | A1 * | 6/2009 | Wu | B25C 1/008 227/8 |
| 2014/0110452 | A1 * | 4/2014 | Moore | B25C 1/008 227/8 |
| 2015/0314432 | A1 | 11/2015 | Yang et al. | |
| 2016/0114470 | A1 * | 4/2016 | Weigmann | B25C 1/008 227/8 |

FOREIGN PATENT DOCUMENTS

| | | | |
|---|---|---|---|
| JP | H09-109058 | A | 4/1997 |
| JP | H09-507172 | A | 7/1997 |
| JP | 3287172 | B2 | 5/2002 |
| JP | 2012-115922 | A | 6/2012 |
| JP | 2014-091196 | A | 5/2014 |

OTHER PUBLICATIONS

Jun. 7, 2016 Written Opinion issued in International Patent Application No. PCT/JP2016/059004.

* cited by examiner

DRIVING TOOL

TECHNICAL FIELD

The present invention relates to a driving tool such as a nail gun etc.

BACKGROUND ART

As an example of existing prior art, in nail guns in which compressed air is used as a driving force, a driving operation is configured to be performed by a main body. This operation is performed on the conditions that a contact arm provided at a tip end of a nose part of the body for driving is moved upwards with respect to an injection opening, that the contact arm is pushed toward a material to be driven (an on-operation of the contact arm), and that a trigger is pulled by a fingertip (an on-operation of the trigger). The driving operation is configured so as not to be performed by only one of the above on-operations, thereby preventing an inadvertent driving operation where all conditions are not met.

Furthermore, in these conventional types of driving tools, various driving operations can be performed, such as a focused driving operation in which the trigger is pulled after the contact arm is on-operated by pushing the contact arm toward the material to be driven, a dragged driving operation in which the trigger is on-operated while the driving tool is moved with the contact arm being on-operated, and a swung driving operation in which the contact arm is turned on/off by moving the driving tool in an up-and-down direction while the trigger is being pulled. In the focused driving and the dragged driving operations, unless the trigger is turned off after the driving operation is performed, the next driving operation cannot be performed (a single driving mode). On the other hand, in the swung driving operation, a continuous driving can be performed while the trigger is being pulled (a continuous driving mode). Japanese Laid-Open Patent Publication No. H9-109058 discloses a mode switch technique in which the single driving and the continuous driving modes can be switched from one mode to the other based on which of the on-operations, of the contact arm or of the trigger, is performed first (a sequential control).

Furthermore, Japanese Patent No. 3287172 discloses a mode switch technique in which each of the on-operations, of the contact arm and the trigger, is respectively detected by a micro switch and an elapsed time after the on-operation of the trigger is measured by a timer. According to this switch technique, in the single driving mode, a driving operation is performed by the on-operation of the contact arm before a predetermined time has passed after the trigger is on-operated. After that, the driving operation is forbidden. This forbidden state can be reset by turning off the trigger.

In contrast, in the continuous driving mode, the reset of the timer and the driving operation can be repeatedly performed on the condition that the contact arm is on-operated before a predetermined time passes after the on-operation of the trigger. At the point in time when the contact arm is not on-operated within a predetermined time measured by the timer, an on-operation after that time is invalid and subsequent driving operation is forbidden. Alternatively, the driving operation can also be forbidden by engaging the contact arm with a lock pin in order to lock to an off position. According to this mode switch technique, for example, in the continuous mode with a grip being held and the trigger being on-operated, even when the contact arm contacts any other portion by accident while the main body is carried, an inadvertent driving operation can be prevented.

However, according to the technique disclosed in Japanese Patent No. 3287172, in a case where a remaining capacity of a battery has decreased and simultaneous power is not being supplied to a controller etc. that can be operated by input signals from the micro-switch or other devices, or in a case where power supply is shut off, the driving operation cannot be performed at all and eventually a work has to be stopped.

The present invention was conceived in order to overcome this known problem, and an object of the present invention is to continue performing the driving operation even if the remaining capacity of the battery becomes low etc.

SUMMARY

The embodiment of the present disclosure relates to a driving tool in which a driving operation is performed by a main body on the condition that both an on-operation of a trigger and an on-operation of a contact arm are performed. In the first embodiment, the driving tool is provided with a first mode (mechanically starting control mode), in which the driving operation is performed by the main body only when the trigger is on-operated after the contact arm is on-operated, and a second mode (electrically starting control mode), in which the driving operation is performed by the main body regardless of an operational order of the on-operations of the trigger and the contact arm, and furthermore these modes are configured to be switchable from one to the other. In the first embodiment, in the second mode, timer control is performed such that the driving operation is performed by the main body if the time difference between a time when either one of the trigger or the contact arm is on-operated, and a time when the other is on-operated, is within a predetermined time period. In contrast, in the first mode, independent from the timer control, the pull-operation of the trigger is mechanically effective, thereby performing the driving operation.

According to the first embodiment, in the first mode, only when the contact arm is first on-operated and subsequently the trigger is on-operated, a pull-operation of the trigger is effective, thereby performing a driving operation. In contrast, in the second mode, depending on whichever of the contact arm or the trigger is first on-operated, a driving operation is performed at a time when the other is also on-operated on the condition that the elapsed time between the first on-operation and the subsequent on-operation is within the predetermined reference time, which is measured by the timer control. Because of this configuration, in the second mode, electric power for operating the controller including the timer control (power for an electric control) is required. Accordingly, in the second mode, when power is interrupted or a remaining capacity of the battery is decreased, the controller does not function, which causes the driving tool to remain in a stopped state. However, by switching the second mode to the first mode, regardless of power supplied to the controller and accompanying timer control, a pull-operation of the trigger through the mechanical configuration of the first mode of the driving tool is able to perform a driving operation, thereby resulting in an ability to continuously to perform a driving operation (single driving operation), independent of power supply. In both the first mode and the second mode, in a case where the driving tool is carried while the grip is held and the trigger is pull-operated, even if the contact arm is on-operated by an unintentional contact of the contact arm to any other part after the predetermined reference time has passed, a redundant driving operation is not performed.

The second embodiment is the driving tool according to the first embodiment, wherein compressed air is used as a driving source for the driving operation, and the driving tool comprises a starting valve by which a mode of supplying the compressed air and a mode of discharging the compressed air can be switched relative to each other, with respect to the main body. In the second embodiment, the driving tool further comprises a first actuation portion that is integrally provided along with the contact arm and moves between an on-position in which it turns the starting valve on and an off-position in which it turns the starting valve off, and a second actuation portion that moves between the on-position and the off-position to turn the starting valve on and off, independently of the first actuation portion. Furthermore, the first actuation portion functions to turn the starting valve on and off both in the first mode and the second mode, whereas the second actuation portion functions to turn the starting valve on and off only in the second mode.

According to the second embodiment, in both the first mode and the second mode, the first actuation portion is moved to the on-position by the on-operation of the contact arm, thereby turning on the starting valve. In the first mode, the starting valve is turned on and off by the movement of the first actuation portion, where the second actuation portion does not affect the on/off operation of the starting valve. Only in the second mode, the second actuation portion relates to the on/off operation of the starting valve. If the starting valve is not turned on by the movement of the first actuation portion to the on-position, then the second actuation portion is moved to the on-position to turn on the starting valve, thereby enabling a continuous driving functionality of the driving tool.

The third embodiment is the driving tool according to the second embodiment, wherein the second actuation portion is configured to move to the on-position by compressed air as a driving source, the compressed air being supplied by switching of an electromagnetic valve.

According to the third embodiment, the second actuation portion is configured to be moved to the on-position by the pneumatic force of the compressed air. In comparison with a configuration in which, for example, a solenoid actuator may be used as a driving force, in this configuration the second actuation portion, due to the pneumatic force of the compressed air, can be moved over a longer distance by a larger force.

The fourth embodiment is the driving tool according to the third embodiment, wherein the compressed air that is supplied to move the second actuation portion by switching of the electromagnetic valve is derived from an accumulator chamber for accumulating compressed air for supplying the main body.

According to the fourth embodiment, the second actuation portion is moved between the on-position and the off-position using the compressed air as a driving source that is supplied to the driving tool. Because of this configuration, the supplied compressed air is effectively used to move the second actuation portion.

The fifth embodiment is the driving tool according to the second embodiment, wherein the driving tool further comprises a first idler and a second idler that are configured to move relatively with the trigger. In the fifth embodiment, the first idler is moved to an on-position by movement of the first actuation portion to the on-position which in turn pushes the first idler, and the second idler is moved to an on-position movement of the second actuation portion to the on-position which in turn pushes the second idler. Furthermore, when the first idler is moved to the on-position, the second idler is also necessarily moved to the on-position along with the first idler. In contrast, the second idler itself may be moved to the on-position independently of the first idler. In the fifth embodiment, the second idler is engaged with a valve stem of the starting valve. Because of this configuration, the valve stem is moved to an on-position by the movement of the second idler to the on-position, thereby supplying compressed air to the main body.

According to the fifth embodiment, the first idler and the second idler are synchronously moved by the on and off operation of the trigger, and also either one of the first idler and the second idler or both move relatively with respect to the trigger by being pushed by the first and/or the second actuation portions. When the first idler is moved to the on-position by being pushed by the movement of the first actuation portion to the on-position, the second idler synchronously moves to the on-position as well. Even in a case where the first idler is not pushed to the on-position by the first actuation portion, when only the second actuation portion is moved to the on-position, the second idler is pushed by the second actuation portion to the on-position. The valve stem of the starting valve is engaged with the second idler. Because of this configuration, in both cases where the first idler is moved to the on-position by being pushed by the first actuation portion and where the second idler is moved independently to the on-position by being pushed by the second actuation portion, the valve stem is pushed to the on-position to turn on the starting valve, thereby performing a driving operation.

The sixth embodiment is the driving tool according to the third embodiment, wherein the driving tool further comprises a first on-position detection member for detecting the on-position of the contact arm, and a second on-position detection member for detecting the on-position of the trigger.

According to the sixth embodiment, each of the on-positions of the contact arm and the trigger is detected by the respective detection member. For the first on-position detection member and the second on-position detection member, for example, micro-switches can be used. By using these detection members, operational modes of the driving tool can be controlled based on the positional detected information of the contact arm and the trigger.

The seventh embodiment is the driving tool according to the sixth invention, wherein the driving tool further comprises a controller for performing an on and off control routine for switching the electromagnetic valve on or off based on positional information of the contact arm and the trigger that is obtained by the first on-position detection member and the second on-position detection member and also based on a time difference between a time when the contact arm is on-operated and a time when the trigger is on-operated.

According to the seventh embodiment, based on the positional information of the contact arm and the trigger and also the time difference between the on-operations, the controller controls the second actuation portion such that the second actuation portion is moved between the on-position and the off-position.

The eighth embodiment is the driving tool according to the seventh embodiment, wherein the driving tool further comprises a mode selector lever for switching from the first mode to the second mode and vice versa. In the eighth embodiment, only when the mode selector lever is switched to the second mode is power supplied to the controller, in order to perform the on and off control (timer control) of the electromagnetic valve based on the positional information of the contact arm and the trigger and also on the time difference (elapsed time) between the on-operations of the contact arm and the trigger.

According to the eighth embodiment, the timer control is performed in the second mode when the mode selector lever is switched to the second mode position. According to the timer control routine, a driving operation is performed on the condition that, for example, the contact arm is on-operated within a predetermined time period after the trigger is on-operated. In a case where the contact arm is on-operated after the predetermined time period has passed after the trigger is on-operated, a driving operation is not performed. Because of this controller configuration, for example, in a case where the driving tool is carried while the grip is held and the trigger is pull-operated, even if the contact arm mistakenly contacts another part and is on-operated, a driving operation is not performed. By switching the mode selector lever to the first mode position, the driving tool can be operated in the first mode. The above-discussed timer control is not performed in the first mode.

BRIEF DESCRIPTION OF THE DRAWINGS

FIG. 6 is a figure showing an operational state of the starting device in a first mode. This figure shows that the trigger is operated and turned on.

FIG. 8 is a figure showing an operational state of the starting device in the first mode. This figure shows a state in which the contact arm is operated and turned on.

FIG. 10 is a figure showing an operational state of the starting device in a second mode. This figure shows a state in which the trigger is operated and turned on.

FIG. 12 is a figure showing an operational state of the starting device in the second mode. This figure shows a state in which the contact arm is operated and turned on.

DETAILED DESCRIPTION OF EMBODIMENTS

INVENTIONS FOR CARRYING OUT THE INVENTION

Figure 1:
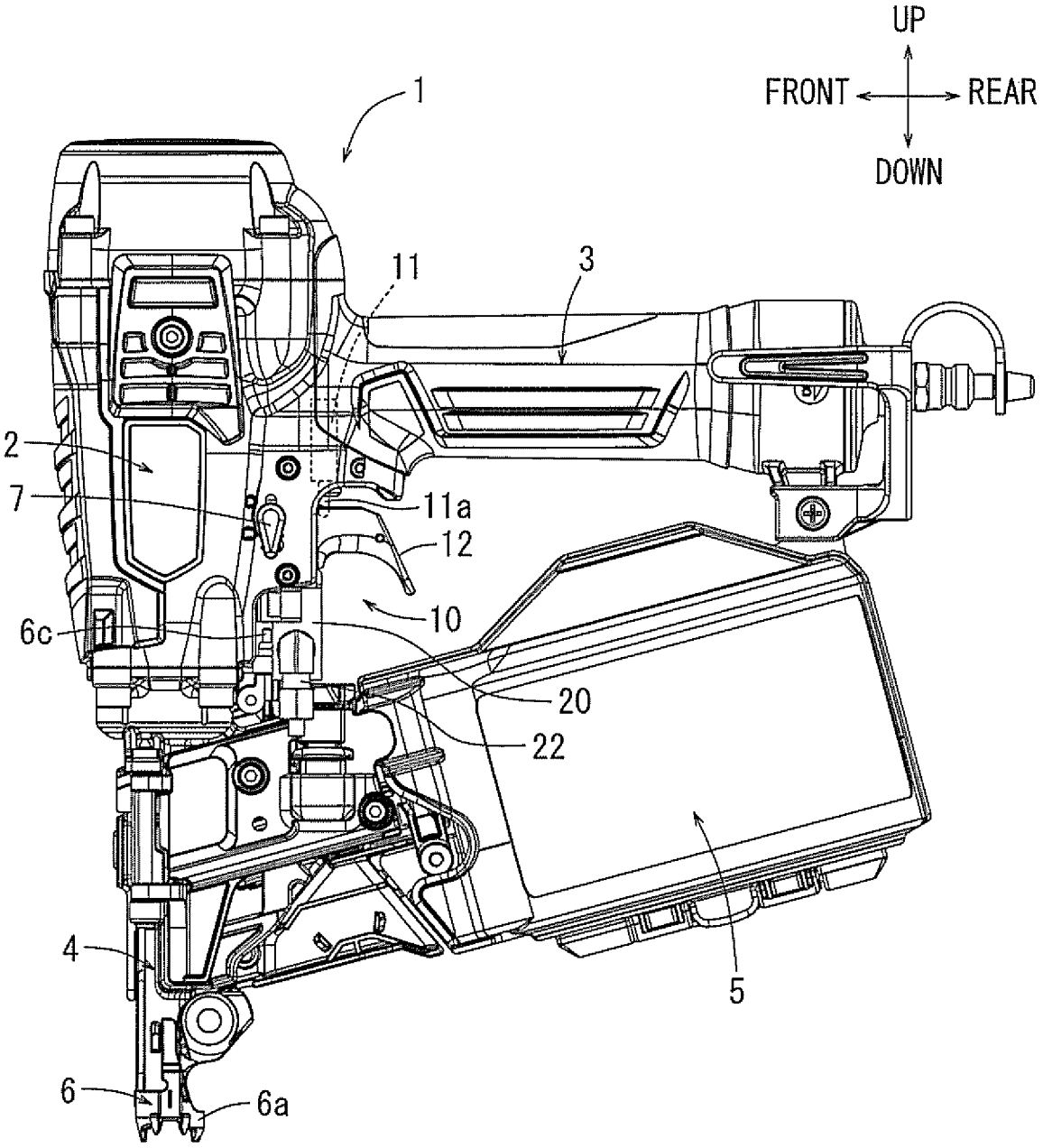
FIG. 1 is an overall lateral view of a driving tool according to an embodiment of the present invention.
Figure 2:
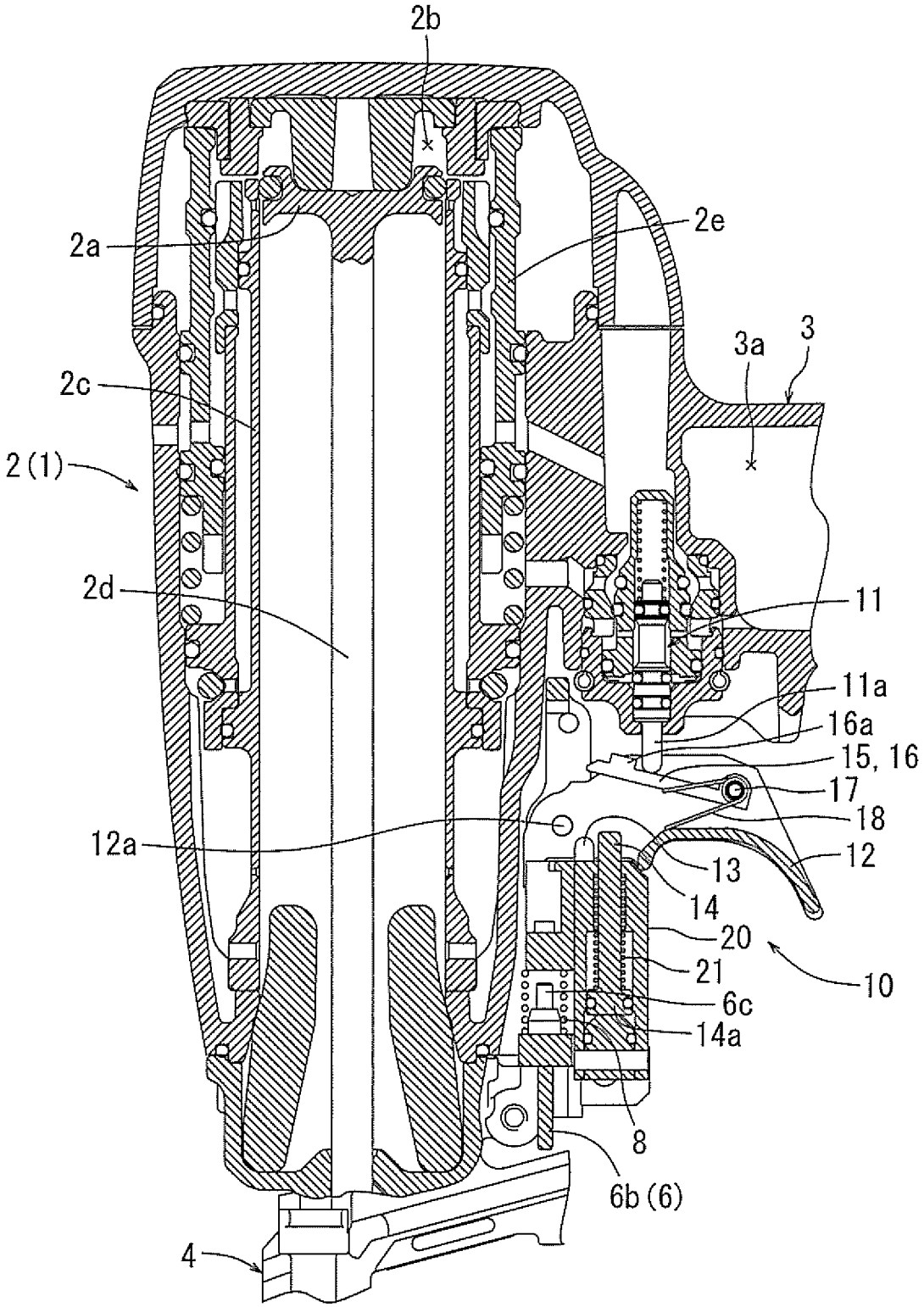
FIG. 2 is a longitudinal sectional view of a main body and a starting device of the driving tool.

Next, an embodiment of the present invention, based on FIGS. 1 to 13, will be explained. As shown in FIG. 1 and FIG. 2, in the present embodiment, a compressed-air-driven nail gun is exemplified as an example of a driving tool 1. The driving tool 1 comprises a main body 2 in which a piston 21 reciprocated by a compressed air as a driving force is internally mounted, a grip 3 that protrudes from a lateral part of the main body 2 in a lateral direction, a nose part 4 for driving that extends from a lower part of the main body 2 in a downward direction (in a driving direction of driven members), and a magazine 5 with which a plurality of driven members can be loaded and which is provided straddling the nose part 4 as well as the grip 3.

At a downward tip end of the nose part 4, a contact arm 6 is supported so as to move relative to the driving tool 1 in an up-down direction. The relative movement of the contact arm 6 in the upward direction when the contact arm 6 is pushed toward a material to be driven is one of the conditions for performing a driving operation. The contact arm 6 includes an annular-shaped contact portion 6*a* that is located around an injection opening at the tip of the nose part 4, and an extension portion 6*b* that extends from the contact portion 6*a* towards a vicinity of a trigger 12 in the upward direction. The contact portion 6*a* and the extension portion 6*b* are supported so as to be synchronously moved in the up-down direction within a predetermined range along the nose part 4.

A starting device 10 according to the present embodiment is disposed at a lateral part of the main body 2 around a base of the grip 3. A starting valve 11 is turned on by a starting operation of the starting device 10. When the starting valve 11 is turned on, compressed air is supplied to an upper piston chamber 2*b* of the main body 2. When the compressed air is supplied to the upper piston chamber 2*b*, a piston 2*a* moves downwards in a cylinder 2*c*. A long rod-shaped driver 2*d* is attached to a lower surface of the piston 2*a*. By the downward movement of the piston 2*a*, and in turn the movement of the driver 2*d* with the nose part 4 due to the movement of piston 2*a*, one driven member is driven out of the tip end (the injection opening) of the nose part 4. The driven member is supplied one by one to the nose part 4 from the magazine 5.

As shown in FIG. 1, a mode selector lever 7 for selecting a first mode or a second mode with regard to a driving mode of the driving tool 1 is provided on a lateral part of the main body 2. In a case where the mode selector 7 is switched to the first mode position, when the trigger 12 is turned on by being pulled after the contact arm 6 is firstly on-operated, the on-operation of the trigger 12 becomes mechanically effective as discussed infra, and a driving operation can be performed. In contrast, when the contact arm 6 is turned on after the trigger 12 is on-operated by being pulled, the on-operation of the contact arm 6 is ineffective and a driving operation is not performed. In the first mode, as described above, a sequential control (mechanical starting control) is performed in which a driving operation can be performed only when the on-operation of the contact arm 6 is first made with respect to an operational sequence of the contact arm 6 and then subsequently the trigger 12. Because of this fixed sequence, the first mode corresponds to a single drive mode in which a subsequent driving operation cannot be performed unless the trigger 12 is turned off after original driving operation has been performed.

Figure 4:
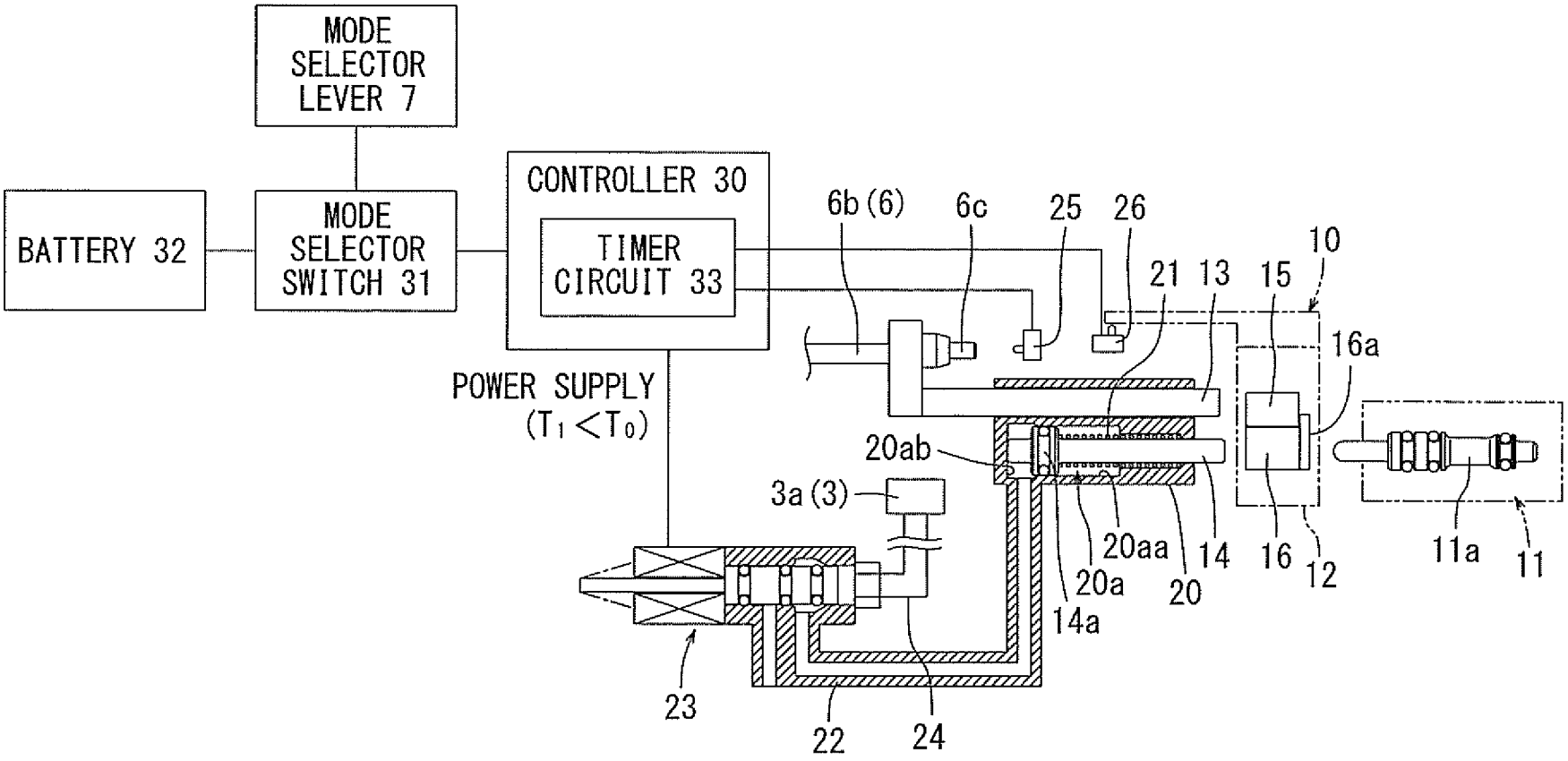
FIG. 4 is a control block diagram of the starting device.

In the case where the mode selector lever 7 is switched to the second mode position, a swung driving (continuous driving) operation can be performed in which a driving operation can be repeatedly performed by swinging the driving tool 1 in the up-down directions with the trigger 12 being pulled and performing the on-off operation of the contact arm 6 repeatedly. As shown in FIG. 4, a switching positional state of the mode selector lever 7 can be detected by a mode selector switch 31. When the mode selector lever 7 is switched to the second mode, the mode selector switch 31 is turned on. An output signal of the mode selector switch 31 is input to the controller 30 as positional information of the mode selector lever 7, as discussed infra. A micro-switch is used for the mode selector switch 31.

Figure 3:
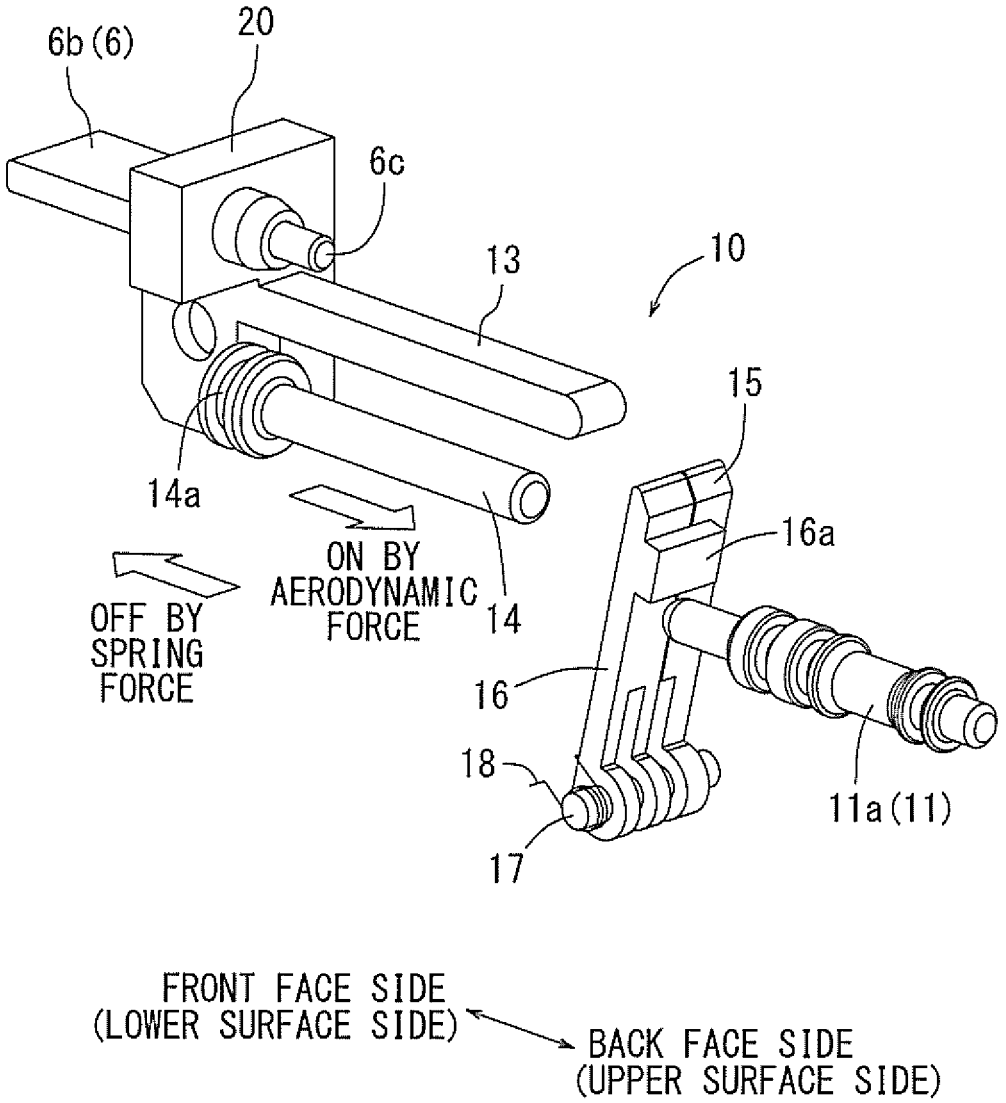
FIG. 3 is a perspective view of the starting device of the driving tool.

The present embodiment will be described with respect to the starting device 10. Details of the starting device 10 of the present embodiment are shown in FIGS. 2 to 4. The starting device 10 of the present embodiment comprises the aforementioned starting valve 11, the trigger 12, a first actuation portion 13, and a second actuation portion 14. The starting valve 11 is housed in a lower surface on the base side of the grip 3. A lower part of the valve stem 11*a* protrudes towards the trigger 12. The valve stem 11*a* of the starting valve 11 is supported so as to be movable in the up-down direction (on position and off position). FIG. 2 shows a state in which the valve stem 11*a* is located in the off position. The starting valve 11 is turned on by the valve stem 11*a* being moved upwards from the off position against a spring biasing force. When the starting valve 11 is turned on, a head valve 2*e* is moved downwards by an air pressure that is applied downwards and the head valve 2*e* opens. When the head valve 2*e* opens, compressed air accumulated in an accumulator chamber 3*a* in the grip 3 is supplied to the upper piston chamber 2*b*. When the valve stem 11*a* is returned in the downward direction by the spring biasing force, the starting valve 11 is turned off. When the starting valve 11 is turned off, the head valve 2*e* is moved upwards by an air pressure applied in the upward direction, which causes the upper piston chamber 2*b* to close with respect to the accumulator chamber 3*a*. The upper piston chamber 2*b* is opened to the atmosphere at the same time when the upper piston chamber 2*b* is closed, which causes the piston 2*a* that has moved downwards to return to a top dead center position (initial position).

The trigger 12 is supported so as to be tiltable around a support shaft 12*a* in the up-down direction. A first idler 15 and a second idler 16 are supported on a backside (an upper side) of the trigger 12. The first idler 15 and the second idler 16 are supported so as to be tiltable independently relative to each other in the up-down direction around a common support shaft 17. Both the first idler 15 and the second idler 16 are biased in a direction to be tiltable in the upward direction by a torsion spring 18 (on-position side).

Figure 11:
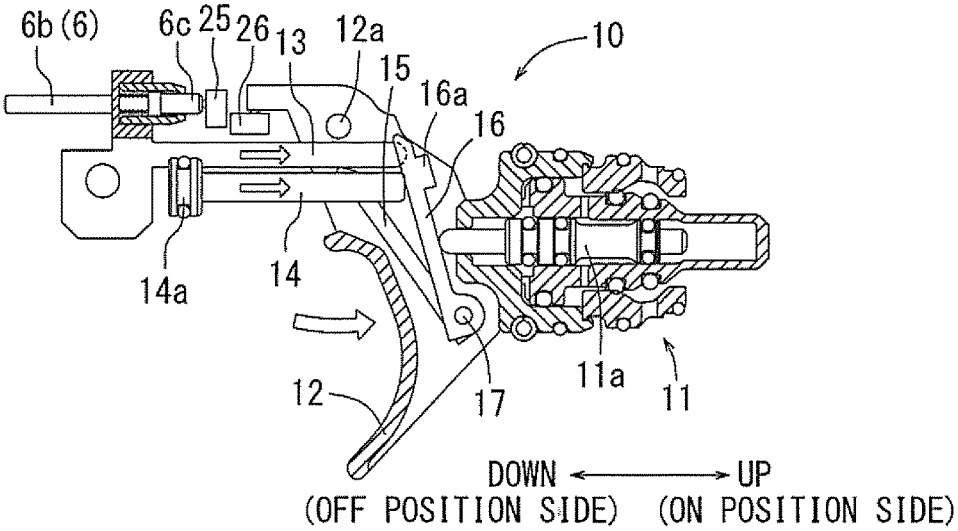
FIG. 11 is a figure showing an operational state of the starting device in the second mode. This figure shows a state in which after the trigger is on-operated, the contact arm is operated and turned on. In this state, a second idler is pushed to an on-position by a second actuation portion, and as a result, the starting valve is turned on and a driving operation is performed.

As shown in FIG. 3, an engagement edge portion 16*a* is provided integrally with the second idler 16 on the backside of the second idler 16. The engagement edge portion 16*a* protrudes towards the back face side of the first idler 15. In an initial state, the engagement edge portion 16*a* is brought into contact with the back face of the first idler 15, and the first idler 15 and the second idler 16 are held in a side-by-side manner such that a front face of the first idler 15 is disposed to be flush with that of the second idler 16. Because of this construction, when the first idler 15 is pushed upwards (to the on-position side), the first idler 15 is tilted upwards integrally with the second idler 16. On the other hand, when the second idler 16 is pushed upwards, only the second idler 16 is tilted upwards. In this way, the first idler 15 can be moved to the on-position integrally with the second idler 16, and the second idler 16 can be moved to the on-position independently. When the second idler 16 is moved to the on-position by itself, the engagement edge portion 16*a* is separated from the back face of the first idler 15. Because of this configuration, a state where only the first idler 15 is disposed in the off-position can be allowed. A state where the first idler 15 is disposed in the off-position and the second idler 16 is moved to the on-position occurs when the trigger 12 is on-operated first in the second mode (FIG. 11). This operating state will be discussed infra.

As shown in FIG. 3, the starting device 10 of the present embodiment comprises the first actuation portion 13 and the second actuation portion 14. The first actuation portion 13 is provided integrally with the contact arm 6. The first actuation portion 13 is provided integrally with an upper part of the extension portion 6*b* of the contact arm 6 and extends towards the trigger 12 (in the upward direction). As shown in FIG. 3 and FIG. 4, a tip end of the first actuation portion 13 is directed towards an upper part of the first idler 15. As the contact arm 6 is moved to the on-position by pushing the material to be driven, the first actuation portion 13 is moved towards the first idler 15 together with the contact arm 6.

As discussed infra, in an on-position state where the trigger 12 is pull-operated, the first actuation portion 13 passes above the first idler 15 (useless operation) when the contact arm 6 is on-operated. In an off-position state where the trigger 12 is not pull-operated, the first actuation portion 13 impinges on the upper part of the first idler 15 when the contact arm 6 is on-operated. By a pull-operation of the trigger 12 with this impinging state being held, the first idler 15 is then further pushed to the on-position against the torsion spring 18. When the first idler 15 is pushed by the first actuation portion 13 and moved to the on-position, the second idler 16, due to the presence of the engagement edge portion 16*a*, is moved to the on-position synchronously with the first idler 15. With the second idler 16 being moved to the on-position, the valve stem 11*a* of the starting valve 11 is pushed to the on-position and the actuation valve 11 is turned on. As discussed earlier, when the starting valve 11 is turned on, the piston 2*a* moves downwards to perform a driving operation.

As shown in FIG. 4, the first actuation portion 13 and the second actuation portion 14 are supported by a support block part 20 that is provided in the main body 2. The first actuation portion 13 is supported by the support block 20 so as to be movable in the up-down direction. In its interior the support block 20 comprises; a cylinder (and/or a cylindrical hollow space) 20*a* which houses the piston 14*a* provided in the second actuation portion 14. The cylinder 20*a* and the piston 14*a* constitute single acting cylinder. The second actuation portion 14 comprises a rod extending vertically through the radial center of this cylinder. An upper chamber 20*aa* of the cylinder 20*a* (a chamber located upwards with respect to the piston 14*a* as shown in the figure) is opened to the atmosphere. A compression spring 21 is interposed between the upper chamber 20*aa* of the cylinder 20*a* and the piston 14*a*. By a biasing force of the compression spring 21, the second actuation portion 14 is returned to the off-position as shown in FIG. 4.

A lower chamber 20*ab* of the cylinder 20*a* (chamber located downwards with respect to the piston 14*a* as shown in the figure) is air-tightly sealed. An electromagnetic valve 23 is connected to the lower chamber 20*ab* of the cylinder 20*a* through an air-pipe 22. The compressed air is supplied to and discharged from the lower chamber 20*ab* by switching the electromagnetic valve 23. When the compressed air is supplied to the lower chamber 20*ab*, the piston 14*a* moves upwards due to the supplied air, which causes the second actuation portion 14 to project in the upward direction (to the on-position) towards the second idler 16. When the second actuation portion 14 is projected upwards by the force of the air pressure, the tip end thereof impinges on the second idler 16. When the second idler 16 is furthermore projected with this impinging state being held, the second idler 16 is pushed upwards against the downwards biasing force of the torsion spring 18. The second idler 16 is pushed by the second actuation portion 14 to move to the on-position, and then the valve stem 11*a* of the starting valve 11 is pushed to the on-position side, which causes the starting valve 11 to turn on.

When the electromagnetic valve 23 is switched to a close position, the lower chamber 20*ab* of the cylinder 20*a* is shut off from the accumulator chamber 3*a* and is instead opened to the atmosphere (compressed air is discharged from the accumulator chamber 3*a*). When the lower chamber 20*ab* is opened to the atmosphere, the piston 14*a* moves downwards by the biasing force of the compression spring 21 and the second actuation portion 14 is returned to the off-position. An air pipe 24 that is divided from the accumulator chamber 3*a* of the grip 3 is connected to the electromagnetic valve 23. Because of this configuration, the compressed air is supplied from the accumulator chamber 3*a* to the lower chamber 20*ab* of the cylinder 20*a* through the electromagnetic valve 23. The open position and the close position of the electromagnetic valve 23 can be switched from one to the other by power that is supplied via the controller 30 that will be discussed infra.

The on-position of the contact arm 6 can be detected by a first on-position detection member 25. As shown in FIG. 4, a detection portion 6*c* of the contact arm is provided at the upper end of the extension portion 6*b* of the contact arm 6. The detection portion 6*c* is spring-biased in an upward protruding direction such that an impact with respect to the first on-position detection member 25 can be absorbed. A compression spring 8 is interposed between the upper end of extension portion 6*b* and the support block 20. By a biasing force of this compression spring 8, the contact arm 6 is biased to a lower off-position configuration (initial position). When the contact arm 6 is disposed at said initial position, the contact portion 6*a* thereof is configured to protrude by a protruding length downward in a protruding direction with respect to the tip end (injection opening) of the nose part 4. A position where the contact arm 6 is relatively moved upwards by this same protruding length is configured to be the on-position of the contact arm 6.

The first on-position detection member 25 is disposed vertically opposite along the up-down axis to the detection portion 6*c*. The first on-position detection member 25 is supported by the support block 20. When the contact arm 6 is moved to the on-position, the detection portion 6*c* is brought into contact with the first on-position detection member 25 and the first on-position detection member 25 is turned on. An on-signal of the first on-position detection member 25 is input to a timer circuit 33 of the controller 30 that will be discussed infra.

An on-position of the trigger 12 is detected by a second on-position detection member 26. The second on-position detection member 26 is supported by the support block 20. When the trigger 12 is pulled to the on-position, a tilted base portion of the trigger 12 is brought into contact with the second on-position detection member 26 and the second on-position detection member 26 is turned on. An on-signal of the second on-position detection member 25 is also input to the timer circuit 33 of the controller 30. Push-button type micro-switches comprise the first and second on-position detection members 25 and 26, respectively.

Both the on-signal of the first on-position detection member 25 and the on-signal of the second on-position detection member 26 are input to the timer circuit 33 of the controller 30. The timer circuit 33 measures an absolute value of input time difference (elapsed time $T_1$) between the on-signal of the on-position detection member 25 and the on-signal of the on-position detection member 26. When it is judged that the input elapsed time $T_1$ between the on-signal of the on-position detection member 25 and the on-signal of the on-position detection member 26 is within a predetermined reference time $T_0(T_1 \leq T_0)$, power is supplied from a battery 32 to the electromagnetic valve 23 by a power supply command of the controller 30. When power is supplied from the battery 32, the power is used to switch the electromagnetic valve 23 to the open position to facilitate communication between the air pipe 22 and the air pipe 24, thereby supplying the compressed air from the accumulator chamber 3*a* to the lower chamber 20*ab* of the cylinder 20*a*. When the compressed air is supplied to the lower chamber 20*ab*, the second actuation portion 14 moves upward into the on-position. When the second actuation portion 14 moves into the on-position, the second idler 16 is consequently pushed to the on-position location by the movement of second actuation portion 14. By the second idler 16 being pushed to the on-position location, the valve stem 11*a* in turn is also moved to the on-position, thereby turning on the starting valve 11. Finally, by the starting valve 11 being turned on, a driving operation is performed by the main body 2.

The stroke extension length between the on-position and the off position of the second actuation portion 14 is set to be approximately equal to the stroke extension length between the on-position and the off-position of the first actuation portion 13. Because of this configuration, as shown in FIGS. 3 and 4, in a case where both the first actuation portion 13 and the second actuation portion 14 are positioned in the off-position, the tip end of the first actuation portion 13 and the tip end of the second actuation portion 14 are separated by a substantially equal space with respect to the first idler 15 and the second idler 16 in the vertical direction, wherein both of the idlers are disposed side by side and rotatably supported around the support shaft 17.

The starting device 10 is provided with the battery 32 that supplies power to the controller 30, the electromagnetic valve 23, the first on-position detection member 25, and the second on-position detection member 26. When the mode selector lever 7 is switched to the second mode position, the mode selector switch 31 is turned on so as to supply power from the battery 32 to the controller 30, the first on-position detection member 25, and the second on-position detection member 26. Furthermore, in the lever's second mode position, under a predetermined condition, power can be supplied from the battery 32 to the electromagnetic valve 23. In contrast, when the mode selector lever 7 is switched to the first mode position, the mode selector switch 31 is turned off and power supply from the battery 32 to the controller 30, the electromagnetic valve 23, the first on-position detection member 25, and the second on-position detection member 26 is shut off.

Because of this configuration, in the first mode, the on-and-off operation of the starting valve 11 can be mechanically controlled only by the first actuation portion 13 of the contact arm 6. Furthermore, in the first mode, the on-position of the first actuation portion 13 is not detected by the first on-position detection member 25 and the on-position of the trigger 12 is not detected by the second on-position detection member 26. In the first mode, the electromagnetic valve 23 is in a stopped state because power supply is shut off, and thus the second actuation portion 14 is not activated and is held in the off-position that is shown in FIG. 4.

Figure 5:
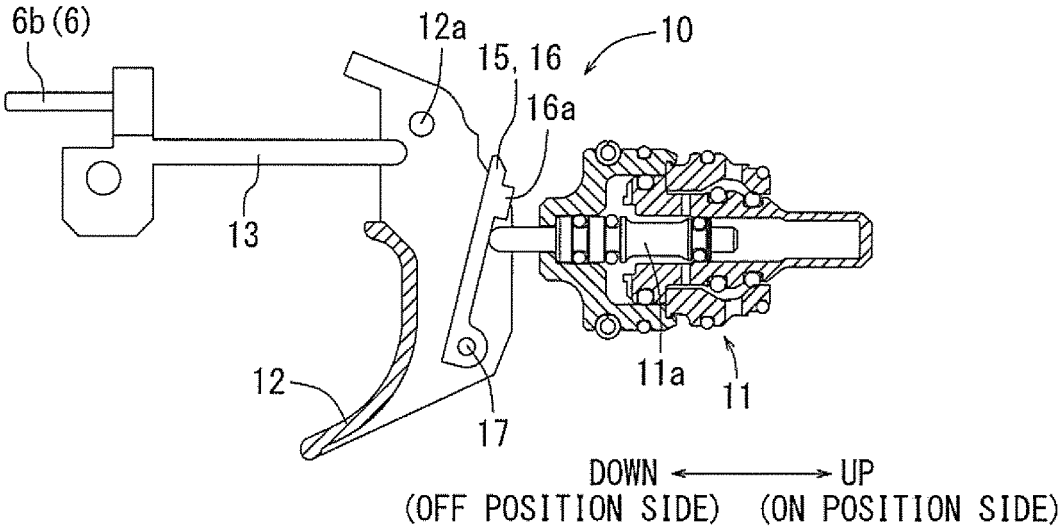
FIG. 5 is a figure showing an operational state of the starting device. This figure shows an initial state. In this initial state, both a trigger and a contact arm are positioned at an off position. A valve stem of a starting valve is positioned at an off position.

In FIGS. 5 to 13, operating states of the starting device 10 in the first mode and in the second mode are shown. In the following description, operating states of the starting device 10 in the first mode and the second mode will be explained. FIG. 5 shows an initial state of the starting device 10, showing a non-operating state in which the contact arm 6 is not on-operated and the trigger 12 is not pull-operated. The initial state of the first mode is common to that of the second mode except the position of the mode selector lever 7 (refer to FIG. 1). Thus, FIG. 5 shows the initial state of both modes.

Figure 6:
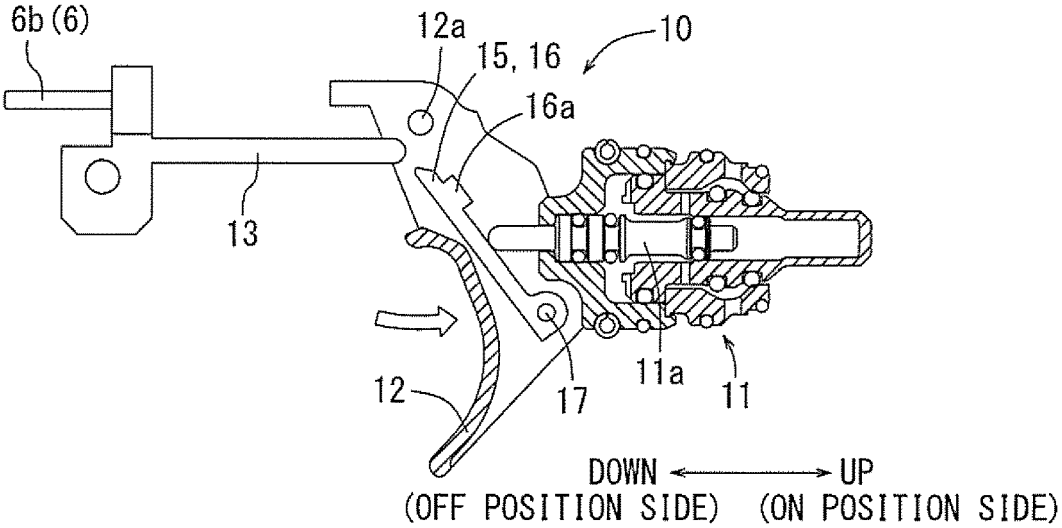
Figure 7:
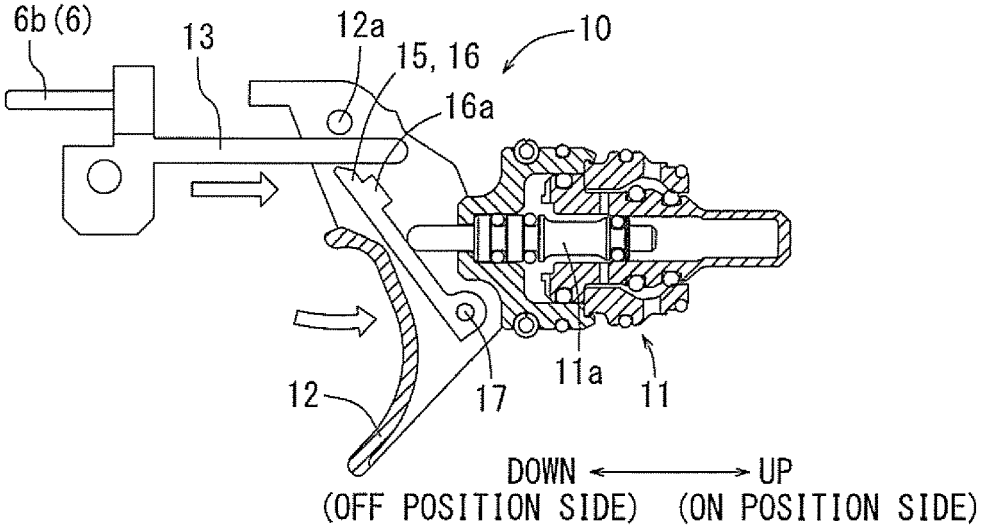
FIG. 7 is a figure showing an operational state of the starting device in the first mode. This figure shows a state in which after the trigger is on-operated, the contact arm is operated and turned on. In this state, the starting valve is not turned on and thus a driving operation is not performed.

At first, a case where the mode selector lever 7 is switched to the first mode position will be described. In FIGS. 5 to 9 that show the first mode, the second actuation portion 14, the first on-position detection portion 25, the second on-position detection portion 26, and the detection portion 6*c*, which function only in the second mode, are not shown. FIG. 6 shows that in the first mode, the trigger 12 is first pull-operated from the initial state shown in FIG. 5. In this state, as shown in the figure, the first idler 15 and the second idler 16 are pushed downwards by a downwards biased spring force of the valve stem 11*a*. As a result, each of the tilted tip ends of the idlers is tilted in a direction to move in the downward direction (leftwards in the figure). Because of this configuration, as shown in FIG. 7, even when the first actuation portion 13 is moved upwards, or in the right direction as viewed in the figure, by the on-operation of the contact arm 6, after the trigger is pull-operated as shown in FIG. 6, the first actuation portion 13 passes a lateral side of the first idler 15 (useless operation). As a result, the first idler 15 is not pushed to the on-position location by the first actuation portion 13 and furthermore the second idler 16 is not moved to the on-position either. As the second idler 16 is not moved to the on-position, the valve stem 11*a* is also not pushed to the on-position location, which keeps the starting valve 11 in the off-position. As the starting valve 11 is not turned on, a driving operation is not performed in this case.

Figure 8:
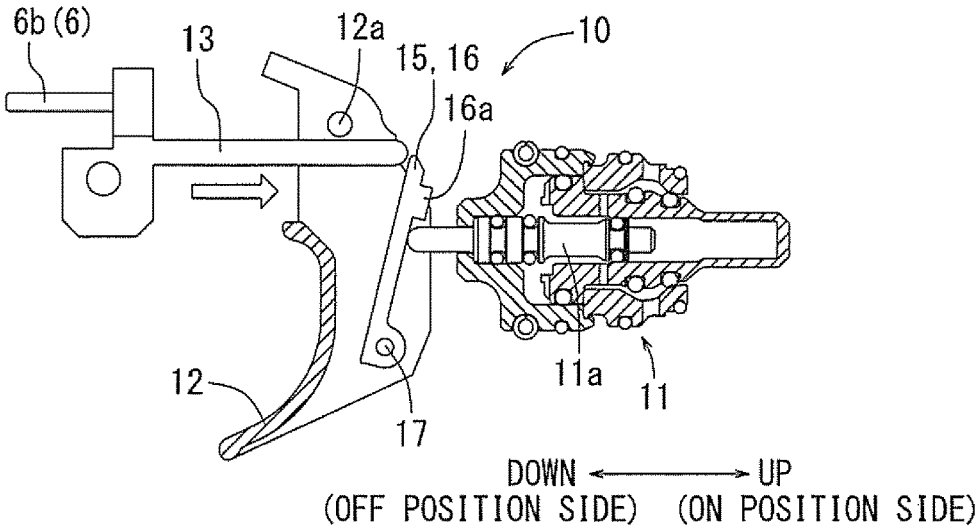
Figure 9:
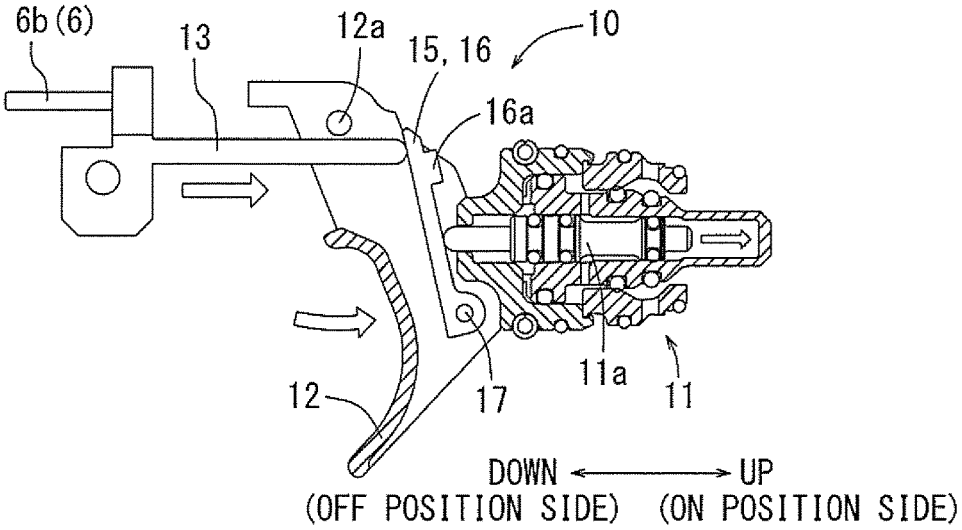
FIG. 9 is a figure showing an operational state of the starting device in the first mode. This figure shows a state in which after the contact arm is on-operated, the trigger is operated and turned on. In this state, the starting valve is turned on and thus a driving operation is performed.

Next, FIG. 8 shows the case where still in the first mode, the contact arm 6 is first on-operated from the initial state shown in FIG. 5. In this state, the first idler 15 is pushed to the starting valve 11 side by the first actuation portion 13. Because of this configuration, where as shown in FIG. 8 the first idler 15 has first been pushed by the contact arm 6, when the trigger 12 is pull-operated afterwards, a tilted tip end of the first idler 15 is pushed by the first actuation portion 13 and a tilted base portion of the first idler 15 is moved to the starting valve 11 side (on location) due to the force of the trigger 12, as shown in FIG. 9. The first idler 15 is moved to the on position and as a result, the second idler 16 is moved to the on position synchronously with the first idler 15 due to the presence of the engagement edge portion 16*a* as explained supra. Consequently, due to the second idler 16 being moved to its on position, the valve stem 11*a* is pushed to its on-position, thereby switching on the starting valve 11. By the starting valve 11 being switched on, a driving operation is performed by the main body 2.

When the contact arm 6 is switched to its off-position by lifting the driving tool 1 from the material to be driven after having completed the driving operation, the driving tool 1 is returned to the state shown in FIG. 6. As shown in the figure, when the contact arm 6 is in its off-position, the first idler 15 is also pushed by the spring force of the valve stem 11*a* to return to its off-position, thereby switching off the starting valve 11. In such a case, even if the trigger is pull-operated and then the contact arm 6 is turned on again, a driving operation (continuous driving) would not be performed because the first actuation portion 13 does not push the first idler 15 to the on-position as shown in FIG. 7. In this case, after the contact arm 6 is turned off, the pulling operation of the trigger 12 must be released to return the tool to the initial state as shown in FIG. 5, thereby making it capable again of performing the next driving operation.

As explained above, in the first mode, in a case where the trigger 12 is first pull-operated (FIG. 6) and then the contact arm 6 is on-operated (FIG. 7), a driving operation is not performed. Because of this configuration, for example, in a case where the driving tool 1 is carried while the grip 3 is held and the trigger 12 is hooked by a finger (while the trigger 12 is pull-operated), even if the contact portion 6*a* of the contact arm 6 inadvertently comes into contact with any other portion, a driving operation cannot be performed. In the first mode, only when the contact arm 6 is first on-operated (FIG. 8) and the trigger 12 is then pull-operated (FIG. 9) a driving operation can be performed. Furthermore, in the first mode, unless the trigger 12 is turned off, a subsequent driving operation cannot be performed (singe driving).

Figure 10:
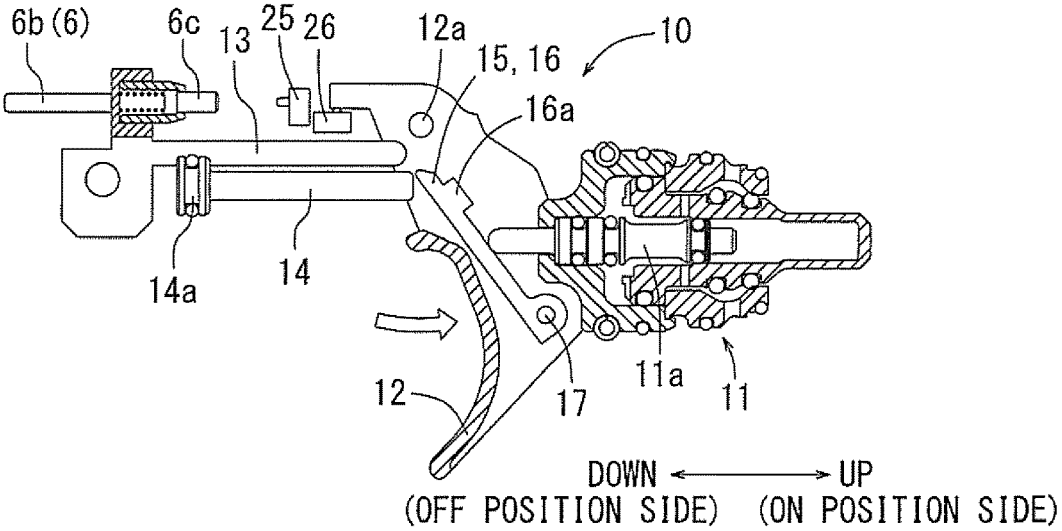

Next, operation states of the starting device 10 when the mode selector lever 7 is switched to the second mode position will be explained. In the initial state shown in FIG. 5, both the first actuation portion 13 and the second actuation portion 14 (not shown in FIG. 5) are disposed in the off-position configuration. As shown in FIG. 10, when the trigger 12 is pull-operated to the on-position from the initial state, the second on-position detection member 26 is switched on and the output signal of said member is input to the timer circuit 33 of the controller 30. However, in this stage, because the first on-position detection member 25 is not switched on, power is not supplied from the controller 30 to the electromagnetic valve 23 and thus the electromagnetic valve 23 is held in the closed position and the second actuation portion 14 is positioned in its off-position. At the moment when the signal from the second on-position detection member 26 is inputted to the timer circuit 33, the timer is activated to measure an elapsed time $T_1$ after that.

As shown in FIG. 11, when the contact arm 6 is on-operated after the pull-operation of trigger 12, the first on-position detection member 25 is turned on and the output signal of said member is inputted to the timer circuit 33 of the controller 30. In the timer circuit 33, the elapsed time $T_1$ after the signal of the second on-position detection member 25 is input to the timer circuit 33 of the controller 30 until the signal of the first on-position detection member 26 is input, is compared to the predetermined reference time $T_0$. When it is judged that the elapsed time $T_1$ is within the reference time $T_0(T_1 \leq T_0)$, a power circuit of the controller 30 is closed and power is supplied from the battery 32 to the electromagnetic valve 23. When power is supplied to the electromagnetic valve 23, the electromagnetic valve 23 is switched to the open position. When the electromagnetic valve 23 is switched to the open position, the air pipe 22 is in fluid communication with the air pipe 24, making it able to supply the compressed air to the lower chamber 20*ab* of the cylinder 20*a* from the accumulator chamber 3*a*, thereby allowing the second actuation portion 14 to move to the on-position against the compression spring 21 and turning on the starting valve 11 to perform a driving operation by the main body 2.

In contrast, in a case where the elapsed time $T_1$ after one of the on-signals of the first on-position detection member 25 and the second on-position detection member 26 is input to the timer circuit 33 of the controller 30 until the other of the on-signals is input is larger than the reference time $T_0(T_1>T_0)$, power is not supplied to the electromagnetic valve 23 from the battery 32. Because of this configuration, a driving operation is not performed in this case.

In this way, in the second mode, when the trigger 12 is first on-operated and the contact arm 6 is then on-operated within the reference time $T_0$, the first actuation portion 13 is moved to the on-position and the second actuation portion 14 is also moved to the on-position almost simultaneously by the power supply to the electromagnetic valve 23. Similar to the first mode, the trigger 12 is first pull-operated, and accordingly upon on-operation of the contact arm 6 the first actuation portion 13 passes the lateral side of the first idler 15 (useless operation). However, in the second mode, if the contact arm is on-operated within the reference time $T_0$ then the second actuation portion 14 is also moved to the on-position, which causes the second idler 16 to be individually tilted to the on-position, while the first idler 15 is still in the off position.

As further shown in FIG. 11, in a state where the second idler 16 is tilted to the on-position while the first idler 15 is still in the off position, the first actuation portion 13 passes the lateral side of the first idler 15. Because of this configuration, although the first idler 15 is biased upward in a direction to tilt to the on-position location by the biasing force of the torsion spring 18, the first idler 15 is restricted to move to the on-position location by the presence of the first actuation portion 13 and thus the first idler 15 is held in the off-position. In the present embodiment, the idler, which is single in the prior art, is split into the first idler 15 and the second idler 16, and thus the second idler 16 is allowed to move to the on-position individually while the first idler 15 is held in the off-position.

The second idler 16 is tilted to the on-position by the pneumatic force of the piston 14*a* within the cylinder 20*a*, resulting in the force pushing the second actuation portion 14 upwards and consequently tilting the second idler 16, in turn pushing the valve stem 11*a* by a required distance and reliably moving the starting valve 11 to the on-position. The valve stem 11*a* is pushed by the movement of the second actuation portion 14 and the second idler 16, thereby turning on the starting valve 11 and accordingly performing a driving operation by the main body 2.

When the contact arm 6 is switched to its off-position by lifting the driving tool 1 from the material to be driven after having completed the driving operation with the trigger 12 being pull-operated after one driving operation is performed, the starting device 10 is returned to the condition shown in FIG. 10. As described earlier, in this condition, the first on-position detection member 25 is turned off by turning off the contact arm 6, thereby shutting off power from the controller 30 to the electromagnetic valve 23. Because of this configuration, the electromagnetic valve 23 is switched to its closed position and the lower chamber 20*ab* of the cylinder 20*a* is opened to the atmosphere, which causes the second actuation member 14 to be moved to the off-position side. With the second actuation portion 14 in its off-position, the pushing force by the second actuation portion 14 is not applied to the second idler 16 in the on-position location, thereby returning the second idler 16 to the off-position by the spring force of the valve stem 11*a* and turning off the starting valve 11. The first idler 15 is not restricted by the first actuation portion 13, but because of the presence of the engagement edge portion 16*a*, the first idler 15 is held side by side with the second idler 16 (in its off-position). Furthermore, by the contact arm 6 being turned off, the first on-position detection member 25 is turned off, thereby resetting the timer circuit 33.

After the starting device 10 returns to the state shown in FIG. 10, when the contact arm 6 is on-operated again within the reference time $T_0$ with the trigger 12 being first pull-operated, then the second actuation portion 14 is again moved to the on-position to push the second idler 16, thereby switching the starting valve 11 to its on position to perform a driving operation again (continuous driving). By bringing the contact portion 6*a* of the contact arm 6 repeatedly into contact with the material to be driven to turn on the contact arm 6 within the reference time $T_0$ while the trigger 12 is pull-operated, the starting device 10 alternates between the state shown in FIG. 10 and the state shown in FIG. 11, thereby performing a continuous driving operation.

Figure 12:
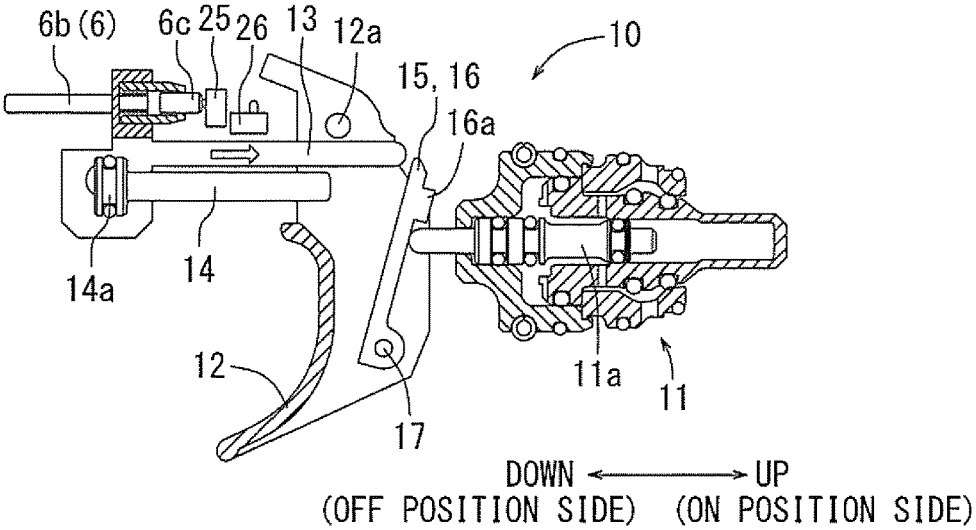

In the second mode, even in a case where the contact arm 6 is first on-operated and after that the trigger 12 is on-operated, contrary to the above case for the second mode, a driving operation can be performed. FIG. 12 shows that the contact arm 6 is first on-operated from the initial state shown in FIG. 5. At this stage, the first on-position detection member 25 is turned on. However, since the trigger 12 is not pull-operated, the second on-position detection member 26 is in the off state and thus power is not supplied to the electromagnetic valve 23 from the controller 30. In a state where power is not supplied, the electromagnetic valve 23 is held switched to the close position and thus compressed air is not supplied to the lower chamber 20*ab* of the cylinder 20*a*, thereby holding the second actuation portion 14 in the off-position.

Figure 13:
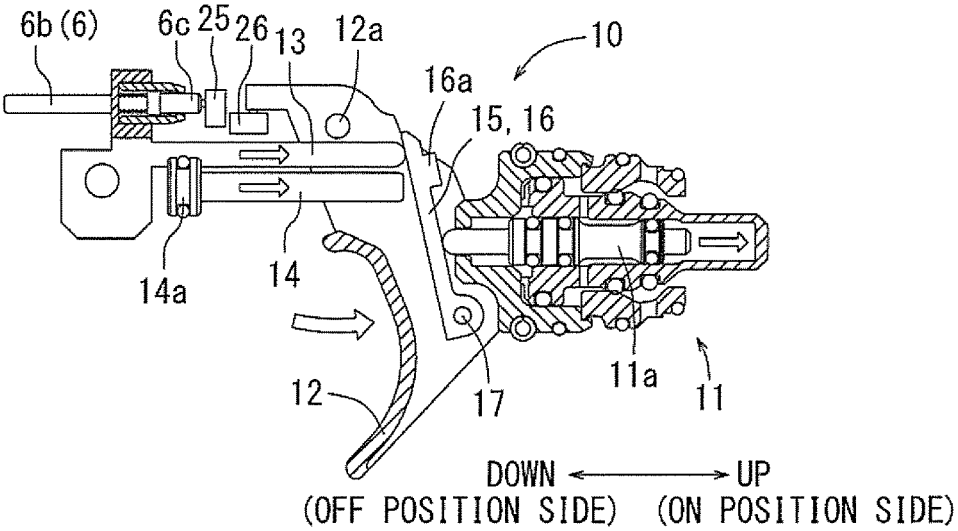
FIG. 13 is a figure showing an operational state of the starting device in the second mode. This figure shows a state in which after the contact arm is on-operated, the trigger is operated and turned on. In this state, both a first idler and the second idler are pushed to an on-position, and as a result, the starting valve is turned on and a driving operation is performed.

When the trigger 12 is pull-operated as shown in FIG. 13 within the reference time $T_0$ after the contact arm 6 is on-operated, a movement of the tilted tip end side of the first idler 15 is restricted by the first actuation portion 13 and thus the first idler 15 is restricted to move to the off-position side. According to the pull-operation of the trigger 12, the valve stem 11*a* is pushed to its on-position, and as a result the starting valve 11 is turned on. By the starting valve 11 being turned on, in turn, a driving operation is performed by the main body 2.

The second on-position detection member 26 is turned on by the pull-operation of the trigger. Because of this procedure, the electromagnetic valve 23 is switched to the open position due to the power being supplied from the controller 30 based on the elapsed time $T_1$ as described, and thus compressed air is supplied to the lower chamber 20*ab* of the cylinder 20*a*, thereby moving the second actuation portion 14 upwards to its on-position. As discussed above, in a case where the contact arm 6 is first on-operated in the second mode, both the first actuation portion 13 and the second actuation portion 14 move to the on-position side. However, the first idler 15 only is being pushed by the first actuation portion 13 that is first moved to the on-position, but due to the presence of the surface 16*a*, the second idler 16 is also synchronously pushed to the on-position, thereby turning on the starting valve 11.

By turning on the starting valve 11, a driving operation is performed by the main body 2. When the pulling operation of the trigger 12 is released after the driving operation, the starting device 10 is returned to the state shown in FIG. 12. Because of this procedure, by pulling the trigger 12 again from the state shown in FIG. 12 within the reference time $T_0$, the starting valve 11 is turned on again, thereby performing the driving operation again. By repeatedly turning on and off the trigger 12 within the reference time $T_0$ while the contact arm 6 is on-operated, the starting device 10 alternates between the state shown in FIG. 12 and the state shown in FIG. 13. According to the second mode in the present embodiment, for example, a so-called dragged driving can be efficiently performed in which while the contact arm 6 is held switched-on, the trigger 12 is on-operated as the driving tool 1 is shifted in the lateral direction. In this dragged driving, one driving operation is performed every time the trigger 12 is on-operated. Because of this procedure, the dragged driving can be considered as a single driving operation along with the first mode.

According to the starting device 10 of the present embodiment as discussed above, in the second mode, in a case where a time difference (elapsed time $T_1$) between the time when the trigger 12 is on-operated and the time when the contact arm 6 is on-operated is within the reference time $T_0$, timer control is performed such that a driving operation is performed by the main body 2. In order to do this, in the second mode, power for operating the controller 30 in which the timer control is performed (power for electric control) is supplied from the battery 32. Because of this procedure, in the second mode, at a time when power from the battery 32 is interrupted or a remaining capacity of the battery 32 decreases, the controller 30 cannot be operated, and as a result the driving tool 1 assumes an operation stopped state. However, in the exemplified driving tool 1, even if this situation happens, subsequent switching of the operating mode to the first mode can separate the timer control of the controller 30 and operate the driving tool 1 (even if power is not supplied), thereby continuing a current driving operation (a single driving by a mechanical starting control). Because of this procedure, continued workability of the driving tool 1 can be improved.

Furthermore, in the first mode, in a case where the trigger 12 is first pull-operated, the on-operation of the contact arm 6 becomes ineffective (useless operation) and as a result the driving operation is not performed (mechanical starting control). Because of this configuration, for example, in a case where the driving tool 1 is carried while the grip 3 is held and the trigger 12 is hooked by a finger, even if the contact portion 6*a* of the contact arm 6 mistakenly comes into contact with any other portion (the contact arm 6 is on-operated), an unintended driving operation cannot be performed.

Furthermore, in the second mode, in a case where a time difference between a time when the trigger 12 is on-operated and a time when the contact arm 6 is on-operated exceeds the reference time $T_0$, power cannot be supplied to the controller 30 and the electromagnetic valve 23 etc. and thus a driving operation cannot be performed by the main body 2. Because of this configuration, in a case where the mode selector lever 7 is switched to the second mode position and where the driving tool 1 is carried while the grip 3 is held and the trigger 12 is hooked by a finger, even if the contact portion 6*a* of the contact arm 6 mistakenly comes into contact with another portion (the contact arm 6 is on-operated), an unintended driving operation cannot be performed.

Furthermore, according to the exemplified starting device 10, the second actuation portion 14 is configured to move to the on-position by the pneumatic force. Accordingly, compared to a configuration in which, for example, a solenoid actuator is used as a power source, the second actuation portion 14 can be moved over a longer distance by a larger force, thereby unfailingly moving the valve stem 11*a* of the starting valve 11 to the on-position.

Furthermore, the compressed air, which is supplied as the power source for driving the main body 2, is configured to be divided to use for moving the second actuation portion 14, and accordingly the supplied compressed air can be effectively used for operating the second actuation portion 14 and eventually the starting device 10.

Furthermore, the driving tool 1 is configured such that electric power of the battery 32 is used only in the second mode and is not consumed in the first mode. Accordingly, compared to a case where electric power is consumed for all driving operations, electric power can be saved.

Various modifications can be made to the embodiments described above. For example, the exemplary configuration uses compressed air as a driving force for moving the second actuation portion 14 to the on-position. Instead, the driving tool 1 can be configured such that an electric motor and a rack-pinion mechanism are used, or a solenoid actuator is used. In these cases, the exemplified electromagnetic valve 23 does not need to be used.

Furthermore, the second actuation portion 14 is configured to move between the on-position and the off-position by the action of piston 14*a* in the cylindrical space 20*a* that is actuated by turning on and off the electromagnetic valve 23. Because of this configuration, the moving direction of the second actuation portion 14 does not necessarily have to be the same as that of the first actuation portion 13, but can be reconfigured to move in a direction different from that of the first actuation portion 13. Furthermore, by extending the air pipe 22, the electromagnetic valve 23 can be arranged to be apart from the second actuation portion 14 (for example, inside the grip 3), thereby improving freedom in the layout of the starting device 10. The controller 30 and the battery 32 may also arranged inside the grip 3.

Furthermore, the nail gun in which the compressed air is used as the driving force is exemplified as the driving tool 1, but the exemplified starting device 10 can also be applied to a driving tool in which an electric motor is used as the driving force.

What is claimed is:

1. A driving tool that uses compressed air as a source for a driving operation, comprising:

a trigger having a trigger on-operation;

a contact arm having a contact arm on-operation;

a starting valve having an on state in which the compressed air is supplied and an off state in which the compressed air is discharged;

a first actuation portion that is integrally provided with the contact arm and moves between a first actuation portion on-position in which the starting valve is moved to the on state and a first actuation portion off-position in which the starting valve is moved to the off state; and a second actuation portion that moves, independently of the first actuation portion, between a second actuation portion on-position thereby moving the starting valve to the on state and a second actuation portion off-position thereby moving the starting valve to the off state, wherein:

the driving tool performs the driving operation only if both the trigger on-operation and the contact arm on-operation occur;

the driving tool has two modes, a first mode, in which the driving operation is performed only when the trigger on-operation occurs after the contact arm on-operation occurs, and a second mode, in which the driving operation is performed regardless of an operational order of the trigger on-operation and the contact arm on-operation, but in the second mode, a timer control routine is performed such that the driving operation is performed only when a time difference between a time when one of the trigger on-operation or the contact arm on-operation occurs and a time when another of the trigger on-operation or the contact arm on-operation occurs is within a predetermined time period;

both in the first mode and in the second mode, the first actuation portion moves to the first actuation portion on-position to allow the starting valve to be moved to the on state and moves to the first actuation portion off-position to allow the starting valve to be moved to the off state; and in the second mode, the second actuation portion moves to the second actuation portion on-position to allow the starting valve to be moved to the on state and moves to the second actuation portion off-position to allow the starting valve to be moved to the off state.

2. The driving tool according to claim 1, wherein the second actuation portion is configured to move to the second actuation portion on-position by the compressed air as a driving source, the compressed air being supplied by switching of an electromagnetic valve.

3. The driving tool according to claim 2, wherein the compressed air that is supplied to the second actuation portion by switching the electromagnetic valve is derived from an accumulator chamber for accumulating the compressed air.

4. The driving tool according to claim 1, wherein:

the driving tool further comprises a first idler and a second idler that move relatively with the trigger;

the first idler is moved to a first idler on-position by a movement of the first actuation portion to the first actuation portion on-position;

the second idler is moved to a second idler on-position by movement of the second actuation portion to the second actuation portion on-position;

when the first idler is moved to the first idler on-position, the second idler is moved synchronously to the second idler on-position;

the second idler can be moved to the second idler on-position independently of the first idler; and the second idler is engaged with a valve stem of the starting valve and the valve stem is moved to a valve stem on-position by the movement of the second idler to the second idler on-position, thereby supplying the compressed air.

5. The driving tool according to claim 2, wherein the driving tool further comprises:

a first on-position detection member for detecting when the contact arm is in the contact arm on-position; and a second on-position detection member for detecting when the trigger is in the trigger on-position.

6. The driving tool according to claim 5, wherein the driving tool further comprises an electronic controller for performing an on-and-off control of the electromagnetic valve based on (1) a positional information of the contact arm and the trigger that is obtained by the first on-position detection member and the second on-position detection member and (2) a time difference between a time when the contact arm is on-operated and a time when the trigger is on-operated.

7. The driving tool according to claim 6, wherein:

the driving tool further comprises a mode selector lever for switching between the first mode and the second mode; and only when the mode selector lever is switched to the second mode, power is supplied to the electronic controller to perform the on-and-off control of the electromagnetic valve based on the positional information of the contact arm and the trigger and the time difference between on-operations of the contact arm and the trigger.

8. A driving tool that uses compressed air as a driving source for a driving operation, comprising:

a main body;

a magazine of members to be driven;

a grip;

a mode switch lever;

an electronic controller with a timer circuit;

a trigger;

a tip end;

a contact arm which vertically contacts an external material onto which the members are to be driven;

a starting valve having an on state in which the compressed air is supplied and an off state in which the compressed air is discharged;

a rod-shaped driver that moves downwards and drives a member from the magazine out of the tip end of the driving tool;

a first actuation portion (1) comprising a first cylindrical rod portion, (2) that is integrally provided with the contact arm and (3) that moves between a first actuation portion on-position in which the starting valve is moved to the on state and a first actuation portion off-position in which the starting valve is moved to the off state; and a second actuation portion (1) comprising a second cylindrical rod portion, a piston and a torsion spring between a top of the piston and the main body and (2) that moves, independently of the first actuation portion, between a second actuation portion on-position thereby moving the starting valve to the on state and a second actuation portion off-position thereby moving the starting valve to the off state; wherein:

the driving tool is configured such that when the driving tool contacts the external material, the contact arm moves upward, whereupon moving upward by a particular length results in a contact arm on-operation and pulling the trigger back by a particular distance results in a trigger on-operation;

the driving tool performs the driving operation only if both the trigger on-operation and the contact arm on-operation occur;

the driving tool has two modes, a first mode, in which the mode switch lever is switched to a first position, where power is not supplied to the electronic controller and in a fully mechanical operation, the driving operation is performed only when the trigger on-operation occurs after the contact arm on operation occurs, and a second mode, in which the mode switch lever is switched to a second position, where power is supplied to the electronic controller, and the driving operation is performed regardless of an operational order of the trigger on-operation and the contact arm on-operation;

in the second mode, a timer control routine is performed by the timer circuit of the controller such that the driving operation is performed only when a time difference between a time when one of the trigger on-operation or the contact arm on-operation occurs and a time when another of the trigger on-operation and contact arm on-operation occurs is within a predetermined time period;

both in the first mode and in the second mode, the first actuation portion moves to the first actuation portion on-position to allow the starting valve to the moved to the on state and moves to the first actuation portion off-position to allow the starting valve to be moved to the off state; and in the second mode, the second actuation portion moves to the second actuation portion on-position to allow the starting valve to be moved to the on state and moves to the second actuation off-position to allow the starting valve to be moved to the off state.

9. The driving tool according to claim 8, wherein the trigger on-operation and the contact arm on-operation are detected by microswitches fitted into a support block within the main body, which are electronically connected to the controller.

10. The driving tool according to claim 9, wherein the second actuation portion is configured to move to the second actuation portion on-position by the compressed air as a driving source, the compressed air being supplied by switching of an electromagnetic valve driven by operation of the controller based on information from the microswitches.

11. The driving tool according to claim 10, wherein the compressed air that is supplied to the second actuation portion by switching the electromagnetic valve is derived from an accumulator chamber for accumulating the compressed air.

12. The driving tool according to claim 9, wherein:

the driving tool further comprises a first idler and a second idler that move rotatably around a common support shaft;

the first idler is moved to a first idler on-position by movement of the first actuation portion to the first actuation portion on-position;

the second idler is moved to a second idler on-position by movement of the second actuation portion to the second actuator portion on-position;

when the first idler is moved to the first idler on-position, the second idler is moved synchronously to the second idler on-position;

the second idler comprises a lateral face that is in touching contact with the first idler;

the second idler is moved to the second idler on-position independently of the first idler; and when the second idler is engaged with a valve stem of the starting valve and the valve stem is moved to a valve stem on-position by the movement of the second idler to the second idler on-position, compressed air is supplied to the main body.

13. The driving tool according to claim 12, wherein the electronic controller performs an on-and-off control of the electromagnetic valve based on (1) positional information of the contact arm and the trigger that is obtained by the microswitches and (2) the timer circuit analyzing a time difference between a time when either of one of the trigger is in the trigger on-position or the contact arm is OR-a time when one of the trigger on-position or the contact arm on-position occurs and a time when another of the trigger on-position or the contact arm on-position occurs.

* * * * *